United States Patent [19]

Venter

[11] Patent Number: 4,683,978

[45] Date of Patent: Aug. 4, 1987

[54] EXHAUST SILENCER

[75] Inventor: Philippus Venter, Vryburg, South Africa

[73] Assignee: Tula Silencers (Propriety) Limited, Vryburg, South Africa

[21] Appl. No.: 798,876

[22] Filed: Nov. 18, 1985

[30] Foreign Application Priority Data

Nov. 22, 1984 [ZA] South Africa ..... 84/9090
Feb. 13, 1985 [ZA] South Africa ..... 85/1088

[51] Int. Cl.[4] ..... F01N 1/12

[52] U.S. Cl. ..... 181/280; 181/258; 181/269; 181/296

[58] Field of Search ..... 181/206, 279, 280, 281, 181/265, 296, 258, 269

[56] References Cited

U.S. PATENT DOCUMENTS

| | | | |
|---|---|---|---|
| 854,778 | 5/1907 | Thomson | 181/280 |
| 969,101 | 8/1910 | Gibson | 181/279 |
| 1,094,667 | 4/1914 | Masten | 181/280 |
| 1,157,256 | 10/1915 | Schmitt | 181/280 |
| 1,353,478 | 9/1920 | Jeffries | 181/279 |
| 1,388,107 | 8/1921 | Ernst | 181/279 X |
| 1,505,893 | 9/1924 | Hunter et al. | 181/280 X |
| 1,612,684 | 12/1926 | Hunter et al. | 181/279 |
| 1,797,310 | 3/1931 | Wright | 181/280 |
| 1,912,544 | 6/1933 | Slidell . | |
| 2,063,270 | 12/1936 | Bacchetti-Righetti | 181/280 |
| 2,108,671 | 2/1938 | Kato | 181/280 X |
| 2,112,006 | 3/1938 | Abramson | 181/279 |
| 2,185,489 | 1/1940 | Wilman . | |
| 2,359,365 | 10/1944 | Katcher | 181/280 |
| 2,583,366 | 1/1952 | Engels . | |
| 2,964,325 | 7/1960 | Gentile . | |
| 3,132,717 | 5/1964 | Baruch . | |
| 3,235,003 | 2/1966 | Smith | 181/279 X |
| 3,393,767 | 7/1968 | Monk | 181/280 |
| 3,648,802 | 3/1972 | Pierce | 181/280 X |
| 3,700,069 | 10/1972 | Rausch et al. | 181/280 X |
| 3,888,331 | 6/1975 | Wang | 181/280 X |
| 3,913,703 | 10/1975 | Parker | 181/206 |
| 3,957,133 | 5/1976 | Johnson . | |

FOREIGN PATENT DOCUMENTS

| | | | |
|---|---|---|---|
| 349382 | 3/1928 | Belgium . | |
| 1087417 | 2/1955 | France . | |
| 1173807 | 3/1959 | France . | |
| 818175 | 11/1981 | South Africa . | |
| 828560 | 11/1982 | South Africa . | |
| 828638 | 11/1982 | South Africa . | |
| 773657 | 5/1957 | United Kingdom | 181/280 |

*Primary Examiner*—Benjamin R. Fuller
*Attorney, Agent, or Firm*—Browdy and Neimark

[57] ABSTRACT

An exhaust silencer has an inlet opening and an outlet opening spaced axially from the inlet opening and includes a cylindrical shell. A core inside the shell defines at least one axial passage and has at least one helical baffle defining a helical flow passage around the axial flow passage within the shell. The axial flow passage has a barrier at its downstream end and has an upstream opening aligned with the silencer inlet opening. It also has an outlet axially spaced from the axial passage inlet opening, the said outlet being directed transversely outwardly into the downstream half of the helical flow passage, at a region upstream from the barrier.

6 Claims, 3 Drawing Figures

EXHAUST SILENCER

FIELD OF THE INVENTION

This invention relates to a method of silencing the exhaust of an internal combustion engine. It relates also to an exhaust silencer for such an engine.

It is an object of this invention to provide an inexpensive exhaust silencer which is effective, and which has little back pressure.

SUMMARY OF THE INVENTION

Accordingly, the invention provides a method of silencing the exhaust of an internal combustion engine, which includes passing the exhaust gas flow from the engine along an axial flow path and along a helical flow path around the axial flow path; and diverting the flow of gases along the axial flow path at a downstream region in a radially outward direction to intersect the flow of gases along the helical flow path.

The invention extends also to an exhaust silencer having an inlet opening and an outlet opening spaced axially from the inlet opening and which includes a cylindrical shell; and a core inside the shell defining at least one axial flow passage and having at least one helical baffle defining a helical flow passage around the axial flow passage within the shell, the axial flow passage having an upstream inlet opening aligned with the silencer inlet opening and having a transverse outlet axially spaced from the axial flow passage inlet opening and directed transversely outwardly into the downstream half of the helical flow passage, the axial flow passage further having a transverse barrier aligned with its inlet opening and downstream of its transverse outlet.

The helical flow passage at its mean diameter may be two to six times as along as the axial flow passage. The silencer may have an inlet chamber, the helical and axial flow passages leading out of the inlet chamber. The inlet chamber may diverge in a downstream direction from the silencer inlet opening. The axial length of the inlet chamber may be at the most one diameter of the cylindrical shell.

The core may include a central axial tube defining the axial flow passage, and the helical baffle defining the helical flow passage may have at least one full turn around the central axial tube. The ratio of the cross-sectional area of the axial flow passage to the area of the helical flow passage may lie in the range one-fifth and two-thirds.

The transverse outlet out of the axial flow passage may be provided by a cluster of openings through the wall of the tube, spread out axially in the downstream third of the length of the axial flow passage. The flow area of the transverse outlet out of the axial flow passage into the helical flow passage may be at least half the cross-sectional area of the helical flow passage, and at the most may be equal to twice the cross-sectional area of the helical flow passage.

The silencer may have an outlet chamber which converges in a downstream direction from the end of the helical flow passage to the silencer outlet opening. The axial length of the outlet chamber may lie in the range four-tenths of one diameter and two-thirds of one diameter of the cylindrical shell.

The axial pitch of the helical baffle may be at least equal to the radial height of the baffle between the axial flow passage and the cylindrical shell, and at the most may be equal to three times the said radial height.

The cylindrical shell may have an axial length which is at least twice its diameter and at most five times its diameter.

The invention will now be described by way of example with reference to the accompanying diagrammatic drawings.

SPECIFIC DESCRIPTION OF THE EMBODIMENTS

Figure 1:
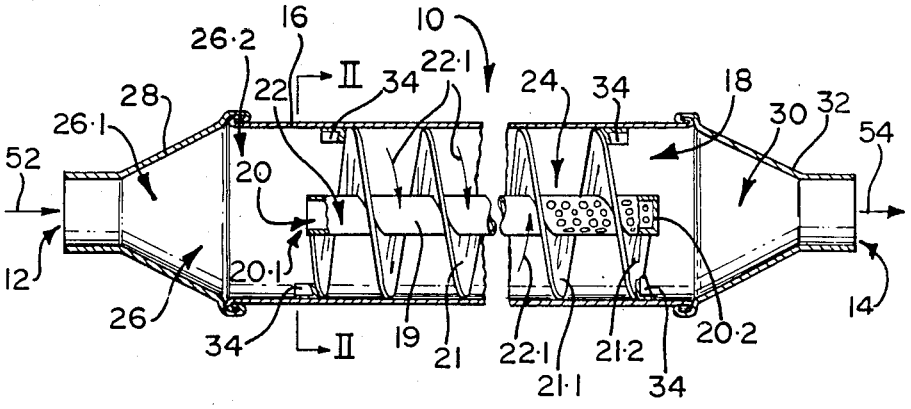
FIG. 1 shows a part-longitudinal section at I—I in FIG. 2 through a silencer according to the invention.
Figure 2:
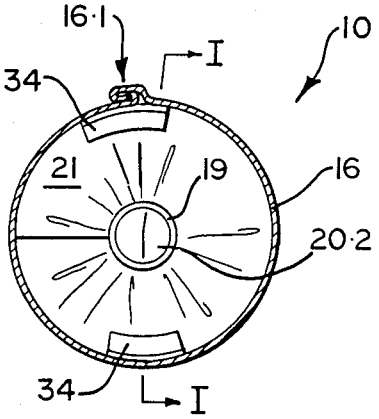
FIG. 2 shows a cross-section at II—II in FIG. 1.

Referring to the drawings, reference numeral 10 refers generally to an exhaust silencer having an inlet opening 12 and an outlet opening 14 spaced axially from the inlet opening 12. The silencer includes a cylindrical shell 16, and a core 18 inside the shell 16. The core includes a central axial tube 19 which defines at least one axial flow passage 20. The core has at least one helical baffle 21 which defines a helical passage 22 around the axial passage 20, within the shell 16. The axial flow passage 20 has an upstream axial inlet 20.1 and has a transverse outlet 24 directed transversely outwardly into the helical passage 22 in the downstream half of the helical passage. The transverse outlet 24 is provided by a plurality of openings arranged as a cluster at the downstream end of the axial passage 20, and between the last two vanes 21.1 and 21.2 of the helical baffle 21.

The silencer has an inlet chamber 26 which includes a frusto-conical shaped part 26.1 defined by a funnel-shaped inlet connection 28, which has an axial length, about half the diameter of the cylindrical shell 16. The inlet chamber also has a cylindrical part 26.2 which has an axial length about half the diameter of the cylindrical shell 16. Likewise, the silencer has an outlet chamber 30 extending downstream from the helical passage, also of frusto-conical shape defined by a funnel-shaped outlet connection 32 which also has an axial length, about half the diameter of the cylindrical shell 16.

The baffle 21 is wound wormscrew fashion around the central axial tube 19 in order to define the helical passage 20. The upstream open end 20.1 of the axial flow passage, is disposed at the downstream end of the cylindrical part 26.2 of the inlet chamber 26. The central axial tube 19 defining the axial flow passage 20, is blanked off by a transverse barrier 20.2 aligned with its upstream axial inlet 20.1 and downstream from its transverse outlet 24.

The baffle 21 is anchored at its upstream and downstream ends, to the cylindrical shell, by means of brackets 34, which are spot-welded to the baffle 21, and to the cylindrical shell 16. In between, it is gripped tightly by the shell 16 wrapped around it and having a longitudinal seam 16.1.

The baffle 21 may have wrinkles or undulations 21.3 (see FIG. 3), the full amplitude of the wrinkles or undulations being at the most one-third the radial depth of the baffle 21 and preferable being about one-quarter the radial depth of the baffle at its root where it is secured to the central tube 19.

Figure 3:
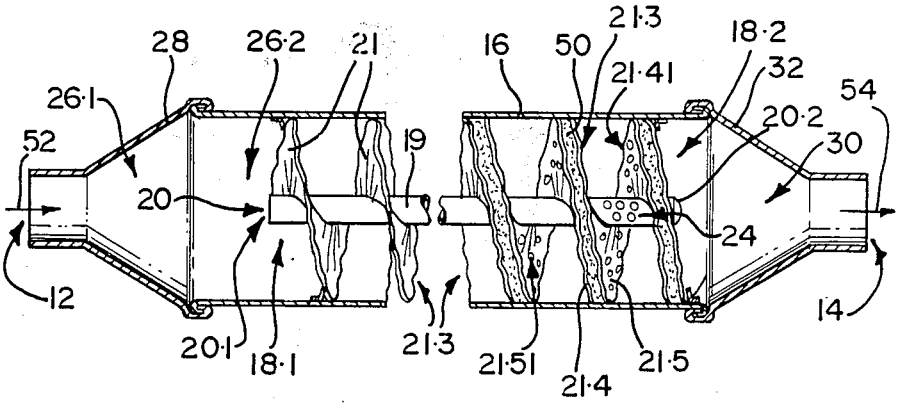
FIG. 3 shows a part-longitudinal axial section through another embodiment of a silencer according to the invention.

Referring further to FIG. 3 of the drawings, there is shown for brevity, two types of core 18.1 and 18.2 inside the shell 16. The downstream part of the drawing, shows a composite baffle made up of upstream and downstream vanes 21.4 and 21.5 respectively, defining a cavity between them, within which insulating material 50, is contained. The vanes may have openings 21.41 and 21.51, to assist in the insulation of sound.

In use, the inlet connection 28 will be connected to the exhaust pipe of an internal combustion engine, and the outlet connection 32 may have a tail-piece connected to it, if desired. The exhaust gases from the engine will enter the inlet chamber 26 of the silencer in the direction of arrow 52 and will be split into two flow paths, namely an axial flow path 20 along the tube 19 and a helical flow path 22 around the axial flow path 20, as indicated by arrows 22.1 along the helical passage defined by baffle 21. The flow of gases in the flow path 20 pass radially outwardly of the tube 19 through the openings 24 and intersect the flow of gases along the helical flow path 22. The length of the axial flow path 20 is about one-fifth the mean length of the helical flow path 22.

The Applicant believes that the wrinkled surface 21.3 of a baffle 21 will have a sound-absorbing effect on exhaust gases impinging on its surface. Furthermore, when a composite baffle with a sound-absorbing cavity between the vanes 21.4 and 21.5 is provided, and also when openings 21.41 are provided in the upstream surface of the vane 21.4 then the sound-absorption capacity of the vane is increased (see FIG. 3).

The cross-sectional flow area of the helical exhaust passage 22 defined by the baffle 21 (whatever its shape or construction) within the cylindrical shell 16, is of the same order as that of the inlet and outlet openings 12 and 14, and is preferably greater. In a typical embodiment, the diameter of inlet and outlet openings 12 and 14 may be 50 mm. The radial length of the baffle 21 may be about 40 mm, and the diameter of the central axial support tube 19 can vary from about 20 mm to about 40 mm, depending upon the size and power of the engine to which the silencer is to be applied. The length of the cylindrical shell may vary from about 250 mm to about 500 mm.

It will be evident from the foregoing description and from the drawings that various combinations of shell, casing, core, and baffle shape, pitch, and construction are possible. The invention extends to the various possible combinations of these features as described and illustrated. Thus, the invention extends to silencers having the baffle shapes or constructions of FIG. 3. Again, the upstream and downstream vanes 21.4 and 21.5 may be plain and need not have wrinkles 21.3. Only the upstream vane 21.4 needs to have wrinkles. Both upstream and downstream vanes with or without wrinkles 21.3 may be foraminous, and a damper or filler material may be provided between vanes 21.4 and 21.5 or may be leftout. When left out, then openings in upstream and downstream flights are preferably randomly dispersed to be out of alignment. Likewise, the ratios of flow areas between helical passage and inlet and outlet openings apply, whatever the type or shape of baffle. The various features described are also applicable with the various ratios of helical and axial flow passage lengths.

The Applicant believes that silencers in accordance with the invention can provide relatively inexpensive and good damping of the noise of the exhaust gases of an internal combustion engine, without excessive back pressure.

The dimensions given are those for motor cars and light commercial vehicles having engines of up to say 5 liter capacity.

For larger engines or for high performance engines, the diameter of the cylindrical shell of the silencer or its length may be increased, or both may be increased.

I claim:

1. An exhaust silencer having an axial inlet opening and an axial outlet opening spaced axially from the inlet opening, and which includes a cylindrical shell;

a central axial tube within and co-axially aligned with the shell and with the silencer inlet and outlet openings, the said tube defining an axial flow passage and being open at its upstream end and closed by a transverse barrier at its downstream end, the axial flow passage having its outlet in the downstream end of the said tube transversely through the wall of the said tube, upstream of the transverse barrier, the open upstream end of the tube being spaced axially downstream from the silencer inlet opening; and a helical vane around the tube and defining a helical passage around the tube within the shell.

2. A silencer as claimed in claim 1, in which the outlet of the axial flow passage is provided by a cluster of openings through the wall of the central axial tube in the downstream third of the length of the central axial tube.

3. A silencer as claimed in claim 2, in which some of the openings forming part of the cluster are provided downstream of a last flight of the helical vane.

4. A silencer as claimed in claim 1, in which the outlet out of the axial flow passage is provided by a cluster of openings through the wall of the central axial tube, between the last two flights of the helical vane.

5. An exhaust silencer which includes a cylindrical shell having an inlet chamber and an outlet chamber spaced axially downstream from the inlet chamber and having an axial inlet opening leading into the inlet chamber, and having an axial outlet opening spaced axially downstream from the inlet opening and leading out of the outlet chamber, and which further includes a central axial tube within and co-axially aligned with the shell and with the silencer inlet and outlet openings, the said tube defining an axial flow passage having its inlet at its upstream end directed axially upstream, the axial flow passage having a transverse barrier at its downstream end, and having its outlet directed transversely outwardly through the wall of the said tube, upstream of the transverse barrier in the downstream third of the length of the said tube, the inlet of the axial flow passage being spaced axially at least one shell diameter downstream from the silencer inlet opening; and a helical vane around the tube and defining a helical passage around the said tube within the shell, the helical passage terminating at the downstream end of the central axial tube at the upstream end of the outlet chamber.

6. A method of silencing the exhaust of an internal combustion engine, which includes splitting the exhaust gas flow from the engine into an axial flow stream component flowing along an axial flow path, and into a helical flow stream component flowing along a helical flow path around the axial flow path; and causing the axial flow stream component to flow transversely outwardly out of the axial flow path outlet within the downstream third of the axial flow path, to intersect and to merge with the helical flow component, to form a unitary flow stream flowing downstream away from the region of intersection.

* * * * *